US009676181B2

(12) United States Patent
Tomizawa et al.

(10) Patent No.: US 9,676,181 B2
(45) Date of Patent: Jun. 13, 2017

(54) METHOD FOR CONTROLLING LIQUID EJECTION HEAD AND LIQUID EJECTING APPARATUS

(71) Applicant: CANON KABUSHIKI KAISHA, Tokyo (JP)

(72) Inventors: Keiji Tomizawa, Yokohama (JP); Takuma Kodoi, Kawasaki (JP); Chiaki Muraoka, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/222,272

(22) Filed: Jul. 28, 2016

(65) Prior Publication Data

US 2017/0028712 A1 Feb. 2, 2017

(30) Foreign Application Priority Data

Jul. 30, 2015 (JP) ..... 2015-150902

(51) Int. Cl.
*B41J 2/045* (2006.01)
*B41J 2/05* (2006.01)

(52) U.S. Cl.
CPC ..... *B41J 2/04541* (2013.01); *B41J 2/0458* (2013.01); *B41J 2/05* (2013.01)

(58) Field of Classification Search
CPC ..... B41J 2/04541; B41J 2/0458; B41J 2/05; B41J 2002/37
See application file for complete search history.

(56) References Cited

U.S. PATENT DOCUMENTS 6,193,347 B1 * 2/2001 Askeland ..... B41J 2/04505 347/15
6,354,698 B1 * 3/2002 Tachihara ..... B41J 2/1404 347/56
6,830,317 B2 12/2004 Tsuchii et al.
6,935,723 B2 8/2005 Murakami et al.
6,971,736 B2 12/2005 Tomizawa et al.
7,108,352 B2 9/2006 Muraoka
7,591,531 B2 * 9/2009 Tsuchii ..... B41J 2/1404 347/40
7,591,537 B2 9/2009 Tsuchii et al.
7,784,904 B2 8/2010 Ide et al.
7,959,260 B2 * 6/2011 Tsukuda ..... B41J 2/1404 347/44
7,963,635 B2 6/2011 Oikawa et al.
7,980,663 B2 7/2011 Matsumoto et al.
8,366,247 B2 * 2/2013 Miyakoshi ..... B41J 2/1404 347/68
8,544,977 B2 10/2013 Kodoi
8,746,845 B2 6/2014 Kodoi

FOREIGN PATENT DOCUMENTS

JP 11-170524 A 6/1999

* cited by examiner

*Primary Examiner* — Anh T. N. Vo
(74) *Attorney, Agent, or Firm* — Fitzpatrick, Cella, Harper & Scinto

(57) ABSTRACT

A method for stabilizing a refilling speed within a predetermined range even with various physical properties of liquid to be ejected is provided for a liquid ejection head using a thermal system. To achieve this, a drive pulse is controlled for each nozzle array according to the combination of a predetermined material and structure of a bubble-generating chamber and the physical property of the liquid to be ejected such that an amount of an overshoot and the refilling speed are within a predetermined range.

13 Claims, 5 Drawing Sheets

Z
Y
X
309
303
311
300
310

302
303
309
301

302
303
309
301

303
309

303

303
320

303
309
320

Z
Y
X
309
303
311
300
310

302
309
303
301

302
309
303
301

309
303

303

303
320

309
303

METHOD FOR CONTROLLING LIQUID EJECTION HEAD AND LIQUID EJECTING APPARATUS

BACKGROUND OF THE INVENTION

Field of the Invention

The present invention relates to control of a liquid ejection head.

Description of the Related Art

A liquid ejection head like an ink jet print head includes a nozzle array having a plurality of nozzle parts for ejecting a liquid droplet by applying thereto a predetermined voltage pulse. In general, each of the nozzle parts includes a liquid chamber for accommodating ink, an energy generating element for applying energy for ejecting the ink inside the liquid chamber, and an ejection port from which the energy-applied ink is ejected as a droplet. Moreover, the liquid ejection head has a mechanism of refilling fresh ink into the liquid chamber according to an amount of missing liquid every time an ejecting operation is performed.

At this time, a refilling speed depends on the material and structure of the liquid chamber, and further depends on the physical properties of liquid. Moreover, in a case where the refilling speed is excessively low, for example, some time is required until preparation of a subsequent ejecting operation is completed, whereby a drive frequency must be set to be low. In contrast, in a case where the refilling speed is excessively high such that a meniscus overshoots from the ejection port, a surface of the ejection port may also be wet and may influence subsequent ejecting operations.

Japanese Patent Laid-Open No. H11-170524 (1999) discloses a method of suppressing long-period undulation of a meniscus along with an ejecting operation in the configuration of using a piezoelectric element as an energy generating element. According to Japanese Patent Laid-Open No. H11-170524 (1999), the piezoelectric element is driven to a direction of drawing back the meniscus while the meniscus heads for an ejection port, thereby dampening a long-period residual vibration of the meniscus along with the ejecting operation and suppressing its influence on subsequent ejecting operations.

Meanwhile, in a liquid ejection head using a thermal system which ejects a liquid droplet by bubble-growing energy generated by film boiling by use of an electrothermal transducer as an energy generating element, a force to draw back the meniscus cannot be generated by drive control. Accordingly, in the liquid ejection head using the thermal system, in general, a flow resistance is increased by adjusting the material or structure of the liquid chamber, and an overshoot of the meniscus is suppressed by reducing the refilling speed.

However, in a case of ejecting inks of different colors by a plurality of nozzle arrays, respectively, as in a color ink jet print apparatus, each of the plurality of nozzle arrays handles the liquid having a different physical property. As a result, even if each nozzle array has the same material and structure, a certain level of variation occurs in the refilling speed. To make the refilling speed uniform, the flow resistance can be adjusted by setting the material and structure differently by each nozzle array, but in this case, cost increase will be a concern. Further, even if such adjustment is made, there is a case, in recent printing apparatuses, where the same print head can be mounted on different types of printing apparatuses. In this case, the same nozzle array even must be adapted to the liquids having different physical properties depending on the type of printing apparatus in which the print head is mounted, and thus, it is difficult to adjust the refilling speed by changing the material and structure of the liquid chamber.

SUMMARY OF THE INVENTION

The present invention has been made to solve the above problem. Accordingly, an object of the present invention is to provide a method for stabilizing a refilling speed within a predetermined range even in a case where liquids to be ejected have various physical properties in a liquid ejection head using a thermal system.

According to a first aspect of the present invention, there is provided a method for controlling a liquid ejection head having a plurality of nozzle arrays, each having a plurality of nozzle parts arranged in rows, each of the plurality of nozzle parts comprising a bubble-generating chamber for accommodating liquid, a heater for applying thermal energy for generating a bubble in the liquid inside the bubble-generating chamber, and an ejection port for ejecting a liquid droplet, wherein among the plurality of nozzle arrays, liquid to be ejected by a first nozzle array and liquid to be ejected by a second nozzle array are different from each other, and by applying different drive pulses to the heater of the first nozzle array and to the heater of the second nozzle array such that bubble-generating power in the first nozzle array is larger than bubble-generating power in the second nozzle array, a refilling speed after ejection from the first nozzle array and a refilling speed after ejection from the second nozzle array are within a predetermined range.

According to a second aspect of the present invention, there is provided a liquid ejection apparatus which mounts a liquid ejection head having a plurality of nozzle arrays, each having a plurality of nozzle parts arranged in rows, each of the plurality of nozzle parts comprising a bubble-generating chamber for accommodating liquid, a heater for applying thermal energy for generating a bubble in the liquid inside the bubble-generating chamber, and an ejection port for ejecting a liquid droplet, and which ejects the liquid from the plurality of nozzle arrays, wherein among the plurality of nozzle arrays, liquids supplied to a first nozzle array and a second nozzle array are different from each other, and by applying different drive pulses to the heater of the first nozzle array and to the heater of the second nozzle array such that bubble-generating power in the first nozzle array is larger than bubble-generating power in the second nozzle array, a refilling speed after ejection from the first nozzle array and a refilling speed after ejection from the second nozzle array are controlled to be within a predetermined range.

According to a third aspect of the present invention, there is provided a liquid ejection apparatus comprising: a first heater configured to generate a bubble in a first liquid and eject the first liquid from an ejection port; and a second heater configured to generate a bubble in a second liquid having higher viscosity than the first liquid and eject the second liquid from an ejection port, wherein a maximum volume of the bubble generated by the first heater in a case of ejecting the first liquid is larger than a maximum volume of the bubble generated by the second heater in a case of ejecting the second liquid.

Further features of the present invention will become apparent from the following description of exemplary embodiments (with reference to the attached drawings).

DESCRIPTION OF THE EMBODIMENTS

Figure 1:
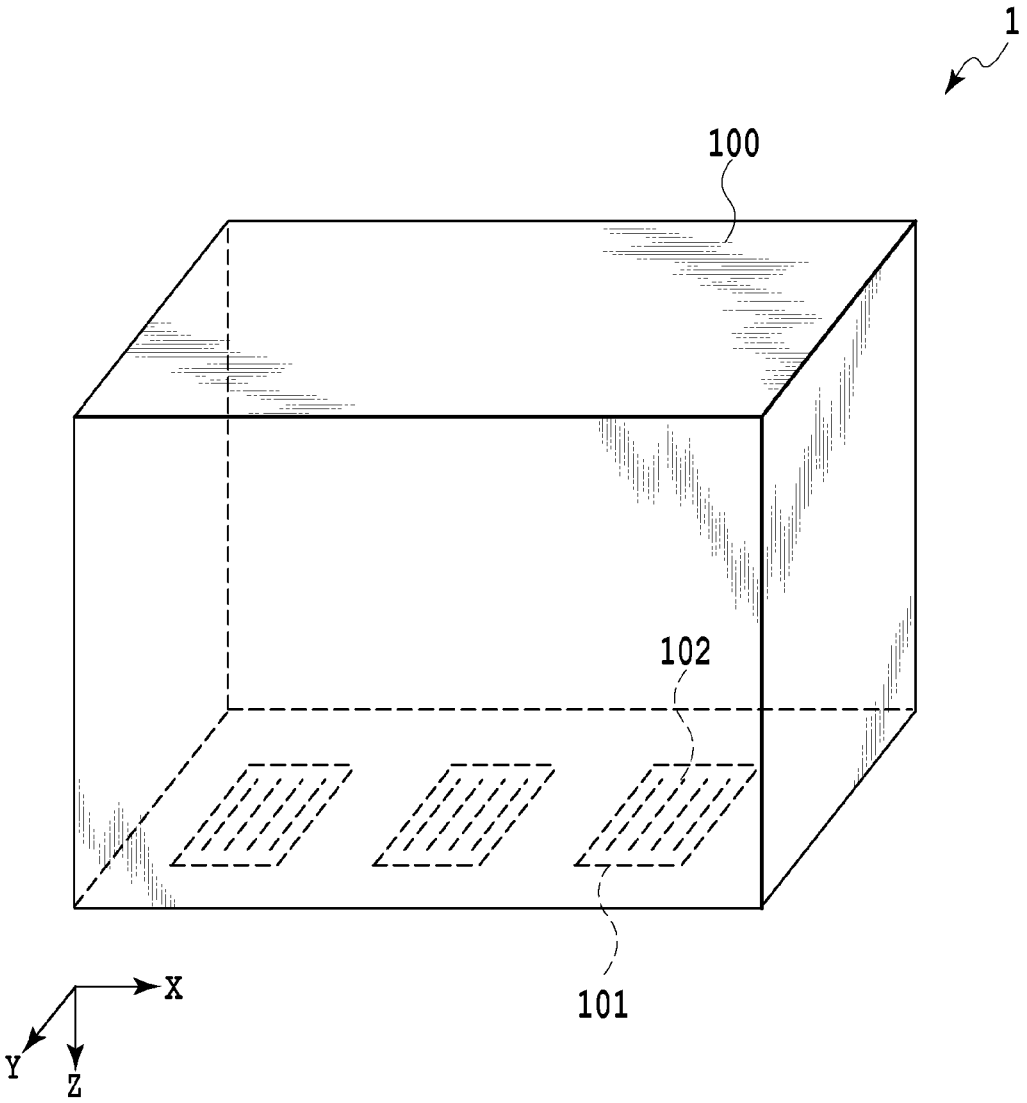
FIG. 1 is a schematic view of an ink jet print head using a thermal system according to the present invention.

FIG. 1 is a schematic view of an ink jet print head 1 using a thermal system which is available as a liquid ejection head according to the present invention. A tank holder 100 includes a plurality of inks accommodated therein, and each of the inks is supplied to a corresponding chip 101.

Figure 2A:
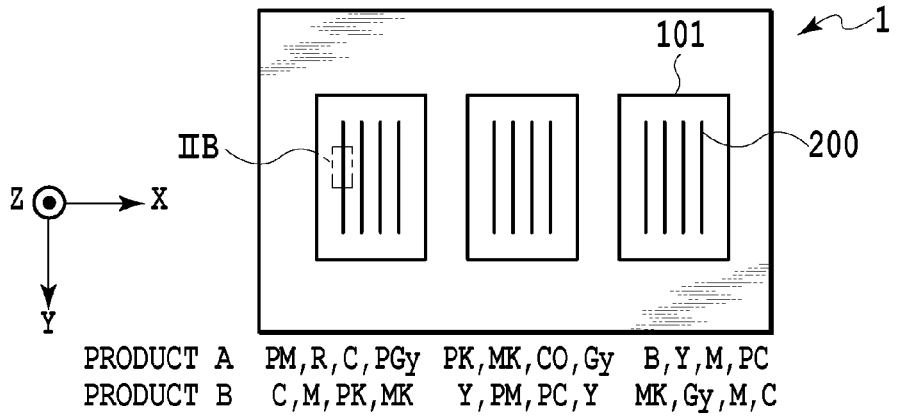
FIGS. 2A to 2C are views for explaining in detail the structure of a chip.
Figure 2B:
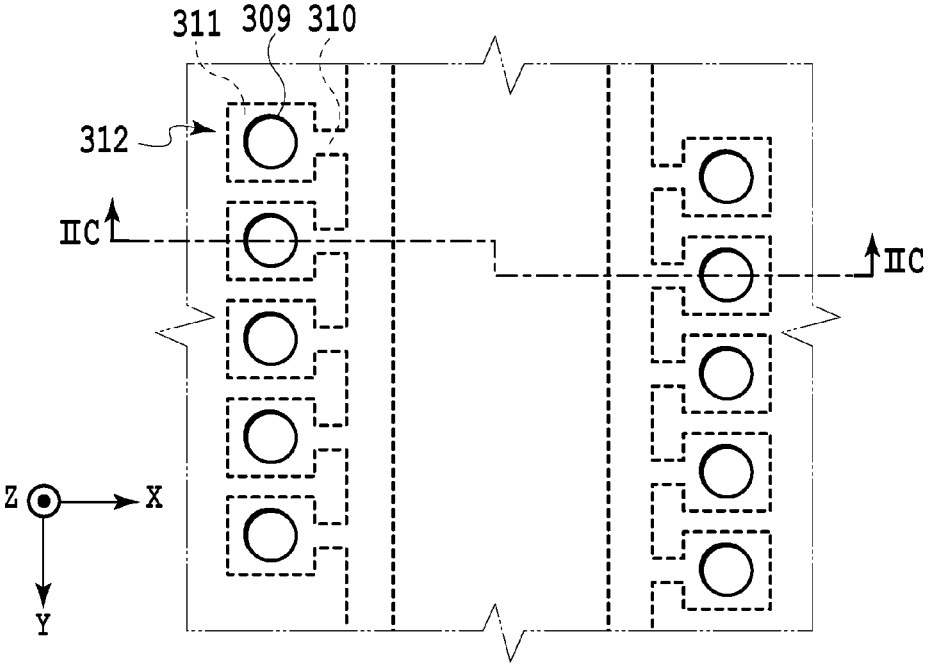
Figure 2C:
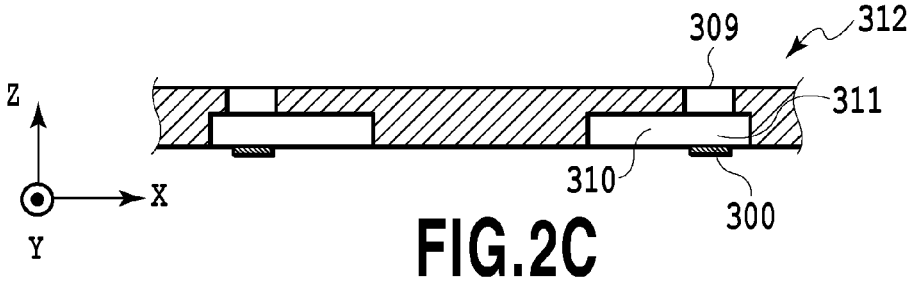

FIGS. 2A to 2C are views for explaining in detail the structure of the chip 101. FIG. 2A is a view showing a surface of an ejection port when observing the ink jet print head 1 shown in FIG. 1 from a z direction. Each of three chips 101 has four rows of nozzle arrays 200 arranged in parallel in an x direction, and further, these three chips 101 are arranged in parallel in the x direction. Each of the nozzle arrays 200 has, with reference to FIG. 2B, a plurality of nozzle parts 312 arranged in a y direction.

FIG. 2C is a cross-sectional view taken along the line IIC-IIC of FIG. 2B. Each of the nozzle parts 312 includes a bubble-generating chamber 311 (liquid chamber) for retaining ink supplied from a flow path 310, a heater 300 for applying thermal energy to the ink in the bubble-generating chamber 311, and an ejection port 309 that serves as an outlet for the ink inside the bubble-generating chamber 311 in which energy is applied. All of the nozzle arrays 200 for all of the chips 101 have the same material and structure.

FIG. 2A shows the types of inks to be ejected in respective cases of mounting a product A and a product B for all twelve rows of the nozzle arrays 200. The product A has a configuration of ejecting twelve different colors of inks from all twelve rows of the nozzle arrays. Meanwhile, in the product B, ink to be ejected from each of the nozzle arrays 200 is specified so that the ink is applied to a print medium in the same order even if the liquid ejection head 1 ejects the ink while moving in a +x direction or ejects the ink while moving in a −x direction. In either case of using the product A or the product B, the twelve rows of the nozzle arrays 200 eject the different types of inks, whereby the refilling speed varies according to the physical property of the ink to be ejected. Further, in a case of focusing on one nozzle array out of the twelve rows, the product A and the product B eject different types of inks and have different refilling speeds.

Figures 3A, 3B, 3C, 3D, 3E, 3F, 3G:
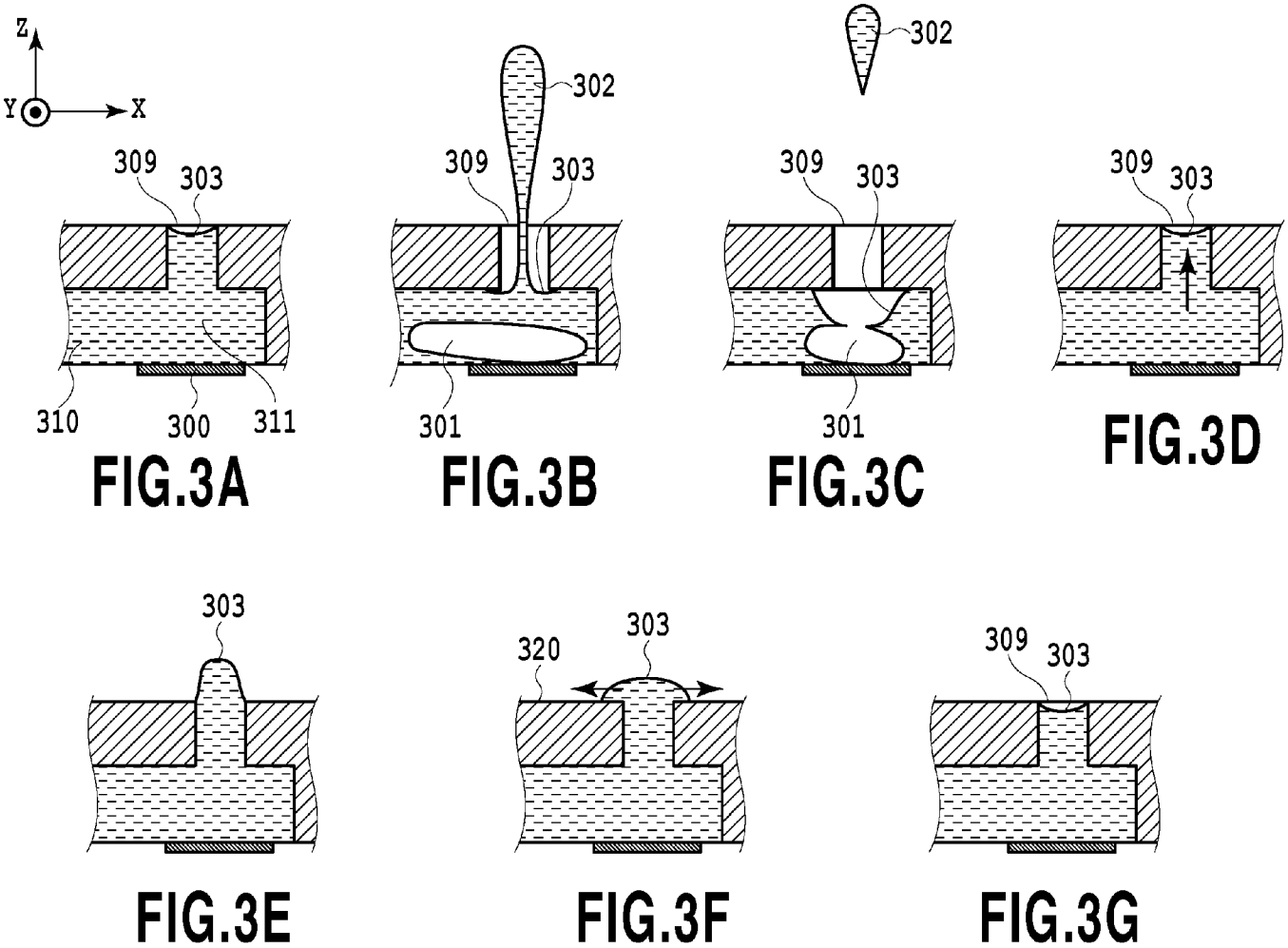
FIGS. 3A to 3G are cross-sectional views for explaining a general state of an ejecting operation.

FIGS. 3A to 3G are cross-sectional views for explaining the general state of one ejecting operation in one nozzle part 312. In an initial state, ink led to the bubble-generating chamber 311 forms a meniscus 303 of a concave shape in the vicinity of the ejection port 309 as shown in FIG. 3A. In a case of applying a voltage pulse to the heater 300, a film boil occurs in the ink adjacent to the heater 300 and a bubble 301 is generated, as shown in FIG. 3B, and along with its growth, the ink becomes an ejecting liquid droplet 302 and is pushed out from the ejection port 309. Thereafter, the liquid droplet 302 comes out in the z direction, as shown in FIG. 3C, the meniscus 303 retracting from the ejection port 309 in a −z direction coalesces with the bubble 301 and the resultant bubble 301 communicates with atmosphere. To be more specific, the bubble 301 generated in the liquid gradually becomes larger, and after the volume of the bubble reaches a maximum, the bubble 301 communicates with atmosphere at the stage of its volume shrinkage.

A negative pressure is generated in the bubble-generating chamber 311 due to the ejection of the liquid droplet 302, and as the bubble 301 shrinks, fresh ink is supplied from the flow path 310. Then the meniscus 303 moves toward the ejection port 309 as shown in FIG. 3D. At this time, the magnitude of the meniscus speed is indicated with an arrow as shown in FIG. 3D. Thereafter, the meniscus 303 overshoots a little from the ejection port 309 as shown in FIG. 3E and spreads out over the surface of the ejection port as shown in FIG. 3F, and then is pulled back into the ejection port 309 again by the negative pressure from the flow path 310. At this time, there may be a case where the meniscus 303 repeats several damped vibrations. Then, when a state returns to a substantially normal position as shown in FIG. 3G, preparation for a next ejecting operation is completed.

Figures 4A, 4B, 4C, 4D, 4E, 4F, 4G:
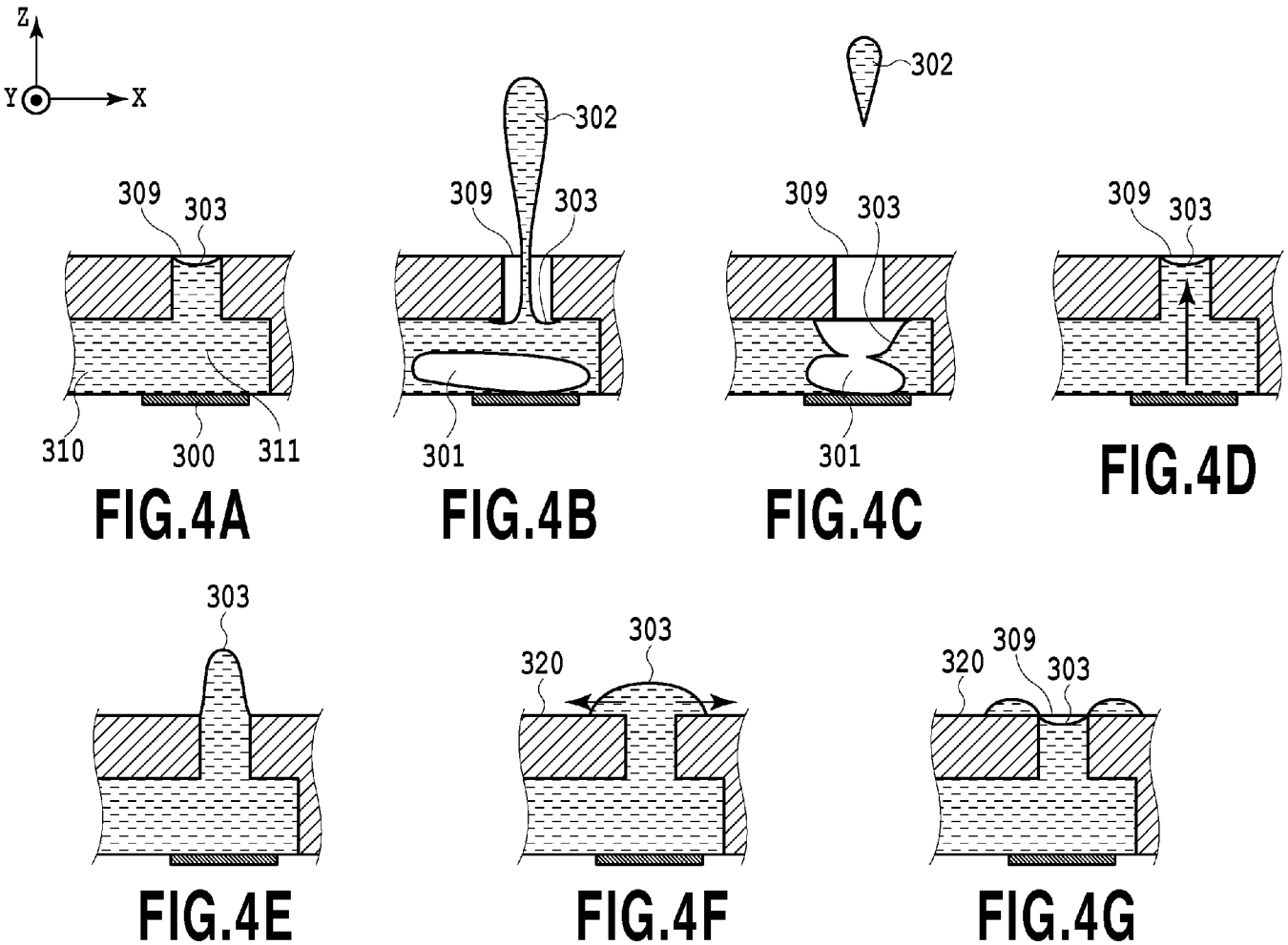
FIGS. 4A to 4G are views showing ejecting operations in a case where a refilling speed is high.

FIGS. 4A to 4G show a case where a refilling speed is high compared to the case shown in FIGS. 3A to 3G due to, for example, low ink viscosity or high surface tension. In this case, even if drive equivalent to the above is performed, a liquid supplying speed from the liquid chamber is higher than the speed indicated by the arrow in FIG. 3D, as shown in FIG. 4D. For this reason, the meniscus 303 greatly overshoots from the ejection port 309 as shown in FIG. 4E and greatly spreads out in the vicinity of the ejection port as shown in FIG. 4F, thereby widely wetting the surface of the ejection port 309. In this case, even if the meniscus 303 returns to a normal position, the surface of the ejection port 309 is still wet as shown in FIG. 4G. Then, if a next ejecting operation is performed in this state, a liquid droplet to be ejected is drawn into the ink adhering onto the surface of the ejection port, and there may be a concern that an ejecting direction is forced to be changed or a non-ejection is introduced.

By the way, immediately after the ejection, a tip portion of the ink that becomes the meniscus 303 later on is, in the process of the shrinkage of the bubble 301 which has been generated, drawn into the bubble-generating chamber 311 by the negative pressure and moves in a direction of the ejecting port. Further, this speed is accelerated during a time period in which the above drawing force is applied, that is, during a time period from the point of atmosphere communication to the point in which the bubble 301 disappears. More specifically, the longer the time period from the atmosphere communication to the bubble disappearance is, the higher the meniscus speed becomes, and the shorter the time period from the atmosphere communication to the bubble disappearance is, the lower the meniscus speed becomes. Meanwhile, the time period from the atmosphere communication to the bubble disappearance depends on a time period from the start of the bubble-generating by the heater drive to the atmosphere communication. Specifically, the longer the time period from the start of the bubble-generating to the atmosphere communication is, the longer the time period from the atmosphere communication to the bubble disappearance becomes as well.

The inventors of the present invention have considered the above state and have concluded that, in a case where the meniscus 303 greatly overshoots and even affects image quality, increasing bubble-generating power at the time of driving the heater to shorten the time period from the start of the bubble-generating to the atmosphere communication is effective. As a result, the time period from the atmosphere communication to the foam disappearance is reduced and the time period of applying force to draw back the meniscus 303 is also reduced, and thus the refilling speed is delayed, and accordingly, the overshoot can be reduced to a smaller amount.

Figures 5A, 5B, 5C, 5D, 5E, 5F, 5G:
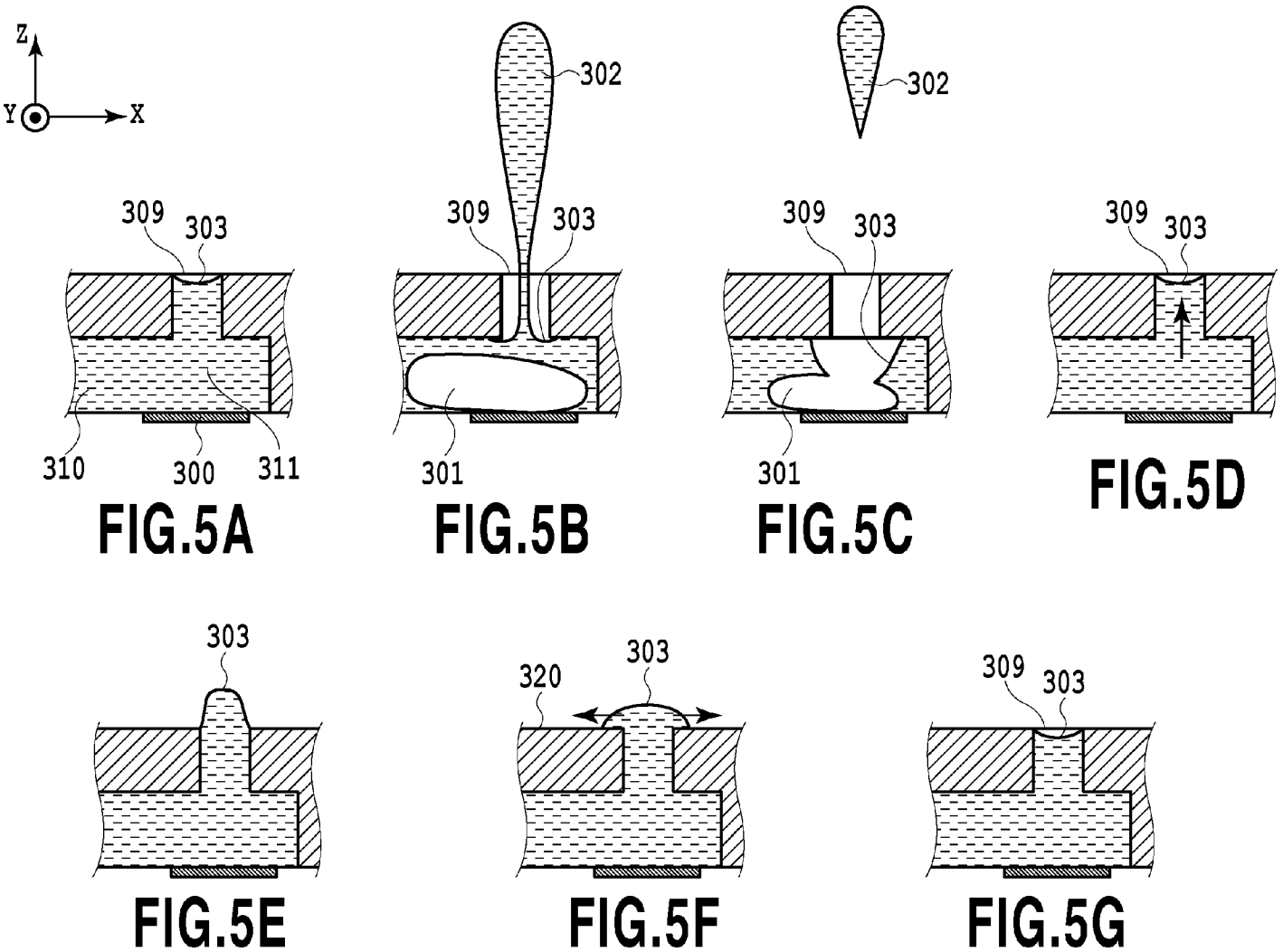
FIGS. 5A to 5G are views showing ejecting operations in a case where the refilling speed is adjusted.

FIGS. 5A to 5G show a case of controlling the amount of the overshoot by using the same ink as in FIGS. 4A to 4G. More specifically, the ink in FIGS. 5A to 5G has the physical property of a high refilling speed compared to the case in FIGS. 3A to 3G, due to, for example, low ink viscosity or high surface tension. A voltage pulse applied to the heater 300 in FIG. 5B has larger energy than the energy in FIG. 4B, and thus larger bubble is generated in a short time to communicate with atmosphere. More specifically, the volume of the bubble at maximum in FIGS. 5A to 5G is larger than the volume of the bubble at maximum in FIGS. 3A to 3G. As a result, a time until the bubble disappearance also shortens, and the refilling speed of ink from the flow path 310 is not so high. Accordingly, as seen in FIG. 5E, the overshoot can be suppressed to a smaller amount compared to the case in FIG. 4E to prevent wetting on the surface of the ejection port.

Incidentally, a method for enlarging the volume of bubble is not particularly limited, but there are, for example, a method for shortening a pulse time by increasing the voltage of a drive pulse to be applied to the heater 300 and a method for adjusting the number of pulses to be applied.

According to the present embodiment, in a case where the print head 1 is mounted on the product A shown in FIG. 2A, for example, with respect to a nozzle array that ejects an ink having particularly high refilling speed among the twelve colors of inks, a voltage pulse may be applied such that bubble-generating power becomes larger than the others. Further, in a case where the refilling speed of a predetermined nozzle array becomes high by changing a product on which the print head 1 is mounted from the product A to a product B, a drive pulse with respect to the nozzle array may be adjusted such that the foaming power becomes large.

Nevertheless, the overshoot amount and the refilling speed vary according to the combination of the predetermined material and structure of the liquid chamber and the physical property of liquid to be ejected, but the present invention is effective in a case where the drive pulse can be controlled per nozzle array such that the overshoot amount and the refilling speed fall within a predetermined range.

However, in a case where the volume of the bubble is large as in FIG. 5B, the amount of a liquid droplet to be ejected, that is, the amount of ejection tends to become large. Moreover, since the size of a dot on a print medium depends on the amount of ejection, there may be a case where a graininess is prominent within an image due to the large amount of ejection. In this case, it is preferable to compare the graininess caused by the larger amount of ejection with an influence on the property of ejection caused by the higher refilling speed and to select either one having less damage. In a case of using an ink having relatively high lightness and less prominent graininess such as light cyan, light magenta, yellow, and clear ink to be applied for improving image quality, the drive pulse having large bubble-generating power may be used by prioritizing the reduction of the refilling speed over the reduction of the graininess. Meanwhile, in a case of using an ink having relatively low lightness and rather prominent graininess such as black, cyan, and magenta, the drive pulse having small bubble-generating power may be used by prioritizing the reduction of the graininess over the reduction of the refilling speed. In addition, in a case where the amount of ejection increases due to the large bubble-generating power and where an ink applying amount per unit area and the density of an image increase, the number of ink ejections (ejection data) may be thinned out.

In this case, it is well known that the above graininess varies according to not only the type of ink but also the type of print medium to be used. Specifically, the graininess tends to be relatively less prominent on plain paper and matte paper, whereas the graininess tends to be rather prominent on coated paper and glossy paper exclusively used for photos. Accordingly, even with the same nozzle array, it is also effective to change the drive pulse depending on the type of print medium to be used.

Furthermore, the refilling speed is influenced by not only the structure of the flow path and the physical properties of ink but also ejection duty (ejection frequency) of the nozzle array. In a case where the ejection duty is high, heat generation from the heater 300 is repeated and thus the viscosity of the ink inside the liquid chamber decreases, thereby making the ink flowable. As a result, the refilling speed increases and the overshoot is likely to occur. Further, in this case, a meniscus vibration is further amplified due to a possibility of a crosstalk with adjacent nozzle parts. Accordingly, in this case, the drive pulse may be changed according to the ejection duty.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-150902, filed Jul. 30, 2015, which is hereby incorporated by reference herein in its entirety.

What is claimed is:

1. A method for controlling a liquid ejection head comprising steps of:

preparing a plurality of nozzle arrays, each having a plurality of nozzle parts arranged in rows, each of the plurality of nozzle parts comprising a bubble-generating chamber for accommodating a liquid, a heater for applying thermal energy for generating a bubble in the liquid inside the bubble-generating chamber, and an ejection port for ejecting a liquid droplet, wherein among the plurality of nozzle arrays, the liquid to be ejected by a first nozzle array and the liquid to be ejected by a second nozzle array are different from each other; and applying different drive pulses to the heater of the first nozzle array and to the heater of the second nozzle array such that bubble-generating power in the first nozzle array is greater than bubble-generating power in the second nozzle array, such that a refilling speed after ejection from the first nozzle array and a refilling speed after ejection from the second nozzle array are within a predetermined range.

2. The method for controlling the liquid ejection head according to claim 1, wherein a material and a structure to form a flow path for leading liquid to the bubble-generating chamber are identical between the first nozzle array and the second nozzle array.

3. The method for controlling the liquid ejection head according to claim 1, wherein the liquid ejection head is an ink jet print head whose plurality of nozzle arrays eject any one of a plurality of inks, the first nozzle array and the second nozzle array eject inks having different colors.

4. The method for controlling the liquid ejection head according to claim 3, wherein ink to be ejected from the first nozzle array is an ink having relatively high lightness among the plurality of inks to be ejected from the plurality of nozzle arrays.

5. The method for controlling the liquid ejection head according to claim 3, wherein bubble-generating power in the first nozzle array varies according to a type of print medium to be printed by the ink jet print head.

6. The method for controlling the liquid ejection head according to claim 3, wherein bubble-generating power in the first nozzle array varies according to ejection duty in the first nozzle array.

7. The method for controlling the liquid ejection head according to claim 1, wherein liquid to be ejected from the first nozzle array has low viscosity compared to liquid to be ejected from the second nozzle array.

8. The method for controlling the liquid ejection head according to claim 1, wherein liquid to be ejected from the first nozzle array has high surface tension compared to liquid to be ejected from the second nozzle array.

9. The method for controlling the liquid ejection head according to claim 1, wherein ejection data with respect to the first nozzle array is thinned out.

10. The method for controlling the liquid ejection head according to claim 1, wherein liquid to be ejected from the first nozzle array in a case where the liquid ejection head is mounted on a first apparatus is different from liquid to be ejected from the first nozzle array in a case where the liquid ejection head is mounted on a second apparatus, and by adjusting a drive pulse to be applied to the heater of the first nozzle array such that bubble-generating power in the first nozzle array differs between a case where the liquid ejection head is mounted on the first apparatus and a case where the liquid ejection head is mounted on the second apparatus, the refilling speed in the first nozzle array in the case where the liquid ejection head is mounted on the first apparatus and the refilling speed in the first nozzle array in the case where the liquid ejection head is mounted on the second apparatus are within a predetermined range.

11. A liquid ejection apparatus which mounts a liquid ejection head having a plurality of nozzle arrays, each having a plurality of nozzle parts arranged in rows, each of the plurality of nozzle parts comprising a bubble-generating chamber for accommodating a liquid, a heater for applying thermal energy for generating a bubble in the liquid inside the bubble-generating chamber, and an ejection port for ejecting a liquid droplet, and which ejects the liquid from the plurality of nozzle arrays, wherein among the plurality of nozzle arrays, liquids supplied to a first nozzle array and a second nozzle array are different from each other, and by applying different drive pulses to the heater of the first nozzle array and to the heater of the second nozzle array such that bubble-generating power in the first nozzle array is greater than bubble-generating power in the second nozzle array, a refilling speed after ejection from the first nozzle array and a refilling speed after ejection from the second nozzle array are controlled to be within a predetermined range.

12. A liquid ejection apparatus comprising:

a first heater configured to generate a bubble in a first liquid and eject the first liquid from an ejection port; and a second heater configured to generate a bubble in a second liquid having higher viscosity than the first liquid and eject the second liquid from an ejection port, wherein a maximum volume of the bubble generated by the first heater in a case of ejecting the first liquid is larger than a maximum volume of the bubble generated by the second heater in a case of ejecting the second liquid.

13. The liquid ejection apparatus according to claim 12, wherein surface tension of the first liquid is higher than surface tension of the second liquid.

* * * * *